US012135190B2

(12) United States Patent
Zimmer et al.

(10) Patent No.: US 12,135,190 B2
(45) Date of Patent: Nov. 5, 2024

(54) PIVOT MOUNT FOR AN OPTICAL AIMING DEVICE

(71) Applicant: Division Group, LLC, Youngsville, LA (US)

(72) Inventors: Trent Zimmer, Youngsville, LA (US); Blake Gettig, Youngsville, LA (US)

( * ) Notice: Subject to any disclaimer, the term of this patent is extended or adjusted under 35 U.S.C. 154(b) by 0 days.

(21) Appl. No.: 18/225,334

(22) Filed: Jul. 24, 2023

(65) Prior Publication Data

US 2024/0027170 A1 Jan. 25, 2024

Related U.S. Application Data

(60) Provisional application No. 63/391,735, filed on Jul. 23, 2022.

(51) Int. Cl.
*F41G 11/00* (2006.01)

(52) U.S. Cl.
CPC ..... *F41G 11/003* (2013.01); *F41G 11/008* (2013.01)

(58) Field of Classification Search
CPC ..... F41G 11/00; F41G 11/001; F41G 11/003; F41G 11/005; F41G 11/006; F41G 11/007; F41G 11/008
See application file for complete search history.

(56) References Cited

U.S. PATENT DOCUMENTS 2,338,200 A * 1/1944 Patterson ..... F41G 11/008 248/229.1
2,725,635 A * 12/1955 Cline ..... F41G 11/008 42/128
2,773,310 A * 12/1956 Bircher ..... F41G 11/008 42/136
3,178,823 A * 4/1965 Lipski ..... F41G 1/38 42/126
3,882,609 A * 5/1975 Troutman ..... F41G 1/28 42/124
4,092,793 A * 6/1978 Ricks ..... F41G 11/008 42/128
4,290,574 A * 9/1981 Archibald ..... F16M 11/242 33/299
5,748,827 A * 5/1998 Holl ..... H01L 21/68 385/136
6,070,749 A * 6/2000 Joulia ..... A45D 40/221 220/817

(Continued)

FOREIGN PATENT DOCUMENTS

CN 215810465 U * 2/2022
CN 116164585 A * 5/2023

(Continued)

*Primary Examiner* — Gabriel J. Klein

(74) *Attorney, Agent, or Firm* — Asgaard Patent Services, LLC; F. Wayne Thompson, Jr.

(57) ABSTRACT

Disclosed are embodiments of a pivot mount for an optical aiming device. The pivot mount can be attached to an accessory rail, such as a MIL-STD-1913 rail, extending along the top of a receiver or handguard of a firearm. The pivot mount allows an attached optical aiming device to be pivoted between a use position and a storage position. The pivot mount is configured to ensure that the optical aiming device returns to zero, within a ¼ milliradian in some implementations, after being pivoted between the use position and the storage position.

6 Claims, 7 Drawing Sheets

(56) References Cited

U.S. PATENT DOCUMENTS

| | | | | |
|---|---|---|---|---|
| 7,173,779 | B2 * | 2/2007 | Shelef | F16M 11/22 359/819 |
| 7,495,849 | B2 * | 2/2009 | Heuser | G02B 7/003 359/811 |
| 7,908,782 | B1 * | 3/2011 | LaRue | F41G 11/008 42/124 |
| 8,438,773 | B2 * | 5/2013 | Carlson | F41G 11/008 42/90 |
| 8,484,882 | B2 * | 7/2013 | Haley | F41G 1/36 42/114 |
| 8,510,983 | B2 * | 8/2013 | Larue | F41G 11/003 42/124 |
| 8,769,859 | B2 * | 7/2014 | Li | F41G 11/001 42/124 |
| 8,793,921 | B1 * | 8/2014 | Tonello | F41G 11/008 42/125 |
| 8,935,875 | B2 * | 1/2015 | Collin | F41G 11/003 42/124 |
| 8,984,797 | B2 | 3/2015 | Ballard | |
| 9,417,034 | B1 * | 8/2016 | Swan | F41G 1/17 |
| 9,683,811 | B1 * | 6/2017 | Warensford | F41G 1/16 |
| 10,317,171 | B2 * | 6/2019 | Odle | F41G 1/08 |
| 10,634,456 | B1 * | 4/2020 | Fischer | F41G 11/003 |
| 10,663,253 | B1 * | 5/2020 | Geissele | F41G 1/16 |
| 11,561,068 | B1 * | 1/2023 | Carter | F41G 11/003 |
| 11,906,269 | B2 * | 2/2024 | Lin | F41G 11/001 |
| 2003/0131518 | A1 * | 7/2003 | Komberger | F41G 11/007 42/135 |
| 2005/0047857 | A1 * | 3/2005 | Soppelsa | F41G 1/26 403/376 |
| 2006/0016061 | A1 * | 1/2006 | Shelef | F02B 77/00 248/562 |
| 2007/0041181 | A1 * | 2/2007 | Shofar | F21V 21/0885 362/157 |
| 2011/0192068 | A1 * | 8/2011 | Samson | F41G 11/003 29/428 |
| 2013/0036650 | A1 * | 2/2013 | Larue | F41G 11/003 42/148 |
| 2013/0160345 | A1 * | 6/2013 | Li | F41G 11/003 42/111 |
| 2014/0137457 | A1 * | 5/2014 | Collin | F41G 11/003 42/90 |
| 2015/0300386 | A1 * | 10/2015 | Fong | F16B 2/10 24/505 |
| 2015/0369419 | A1 * | 12/2015 | Nishikawa | F16M 11/22 248/583 |
| 2016/0069506 | A1 * | 3/2016 | Shelef | F16M 11/22 403/221 |
| 2016/0238346 | A1 * | 8/2016 | DiCarlo | F41G 11/003 |
| 2018/0180386 | A1 * | 6/2018 | Keller | F41G 1/065 |
| 2019/0017784 | A1 * | 1/2019 | Smith | F41G 1/16 |
| 2020/0025522 | A1 | 1/2020 | Zimmer | |
| 2021/0223000 | A1 | 7/2021 | Donahue et al. | |
| 2023/0114998 | A1 * | 4/2023 | Carter | F41G 11/008 42/124 |
| 2024/0003661 | A1 * | 1/2024 | Lin | F41G 11/001 |

FOREIGN PATENT DOCUMENTS

| | | | | |
|---|---|---|---|---|
| CN | 117387422 | A * | 1/2024 | |
| DE | 3128848 | A1 * | 2/1983 | |
| EP | 1754933 | A1 * | 2/2007 | B60Q 3/0269 |
| EP | 3553457 | A1 * | 10/2019 | F41G 11/003 |
| GB | 1253435 | A * | 11/1971 | |
| KR | 20120065177 | A * | 6/2012 | |
| KR | 20230027636 | A * | 2/2023 | |
| WO | WO-2016130921 | A1 * | 8/2016 | F41G 11/003 |

* cited by examiner

PIVOT MOUNT FOR AN OPTICAL AIMING DEVICE

CROSS-REFERENCE TO RELATED APPLICATION(S)

This application claims the benefit of U.S. Provisional Application Ser. No. 63/391,735, filed on Jul. 23, 2022, the entirety of which is incorporated herein by reference.

TECHNICAL FIELD

This disclosure relates to a pivot mount for an optical aiming device. In particular, the present disclosure is directed to implementations of a flip-to-side mount used to attach an optical aiming device to a firearm.

BACKGROUND

A firearm, such as a rifle, is often used in combination with an optical aiming device. The optical aiming device is typically positioned in a user's "line of sight" (e.g., in line with the barrel) so that the user can better align the weapon with the intended target. An example optical aiming device may be a thermal optic. Some thermal optics are configured to be used in tandem with another optical aiming device, such as a telescopic sight, and/or as a stand-alone thermal riflescope. A thermal optic is used in tandem with a telescopic sight to provide the user with a magnified image and the capability to locate and track a target in low-light/no-light environments.

At times it is beneficial to eliminate an optical aiming device from the user's line of sight without removing the optical aiming device from the firearm. It would also be beneficial if the optical aiming device could be removed from and returned to the user's line of sight without the optical aiming device losing zero.

Accordingly, needs exist for the pivot mount disclosed herein. It is to the provision of a pivot mount for an optical aiming device configured to address these needs, and others, that the present invention is primarily directed.

SUMMARY OF THE INVENTION

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed are embodiments of a pivot mount for an optical aiming device. The pivot mount can be attached to an accessory rail, such as a MIL-STD-1913 rail, extending along the top of a receiver or handguard of a firearm. The pivot mount allows an attached optical aiming device to be pivoted between a use position and a storage position. The pivot mount is configured to ensure that the optical aiming device returns to zero, within a ¼ milliradian in some implementations, after being pivoted between the use position and the storage position.

An example pivot mount comprises: a base configured for attachment to an accessory rail, a pivot shaft, and an optic adapter member pivotally secured to the base by the pivot shaft. The base includes a bottom portion and an upper surface; the bottom portion is configured to engage the accessory rail and the upper surface includes a locating pin. The optic adapter member includes an upper surface and a bottom portion; the upper surface is configured for attachment of an optical aiming device and the bottom portion includes a chamfered groove configured to receive the locating pin on the upper surface of the base. The optic adapter member pivots around the pivot shaft between a use position in which the bottom portion of the optic adapter member is adjacent the upper surface of the base and a storage position in which the bottom portion of the optic adapter member is pivoted away from the upper surface of the base. The locating pin on the upper surface of the base is received within the chamfered groove on the bottom portion of the optic adapter member when the optic adapter member is in the use position.

Another example pivot mount comprises: a base configured for attachment to an accessory rail, a pivot shaft, and an optic adapter member pivotally secured to the base by the pivot shaft. The base includes a bottom portion and an upper surface; the bottom portion is configured to engage the accessory rail and the upper surface includes a fore support and an aft support. The supports each having an aperture defined therethrough. The apertures are aligned along a fore-aft pivot axis. The upper portion of the base also includes a locating pin. The pivot shaft engages the apertures in the supports of the base such that the pivot shaft extends along the fore-aft pivot axis. The optic adapter member includes an upper surface and a bottom portion; the upper surface is configured for attachment of the optical aiming device and the bottom portion includes a chamfered groove configured to receive the locating pin of the base. The optic adapter member pivots around the fore-aft pivot axis between a use position in which the bottom portion of the optic adapter member is adjacent the upper surface of the base and a storage position in which the bottom portion of the optic adapter member is pivoted away from the upper surface of the base. The locating pin on the upper surface of the base is received within the chamfered groove on the bottom portion of the optic adapter member when the optic adapter member is in the use position.

BRIEF DESCRIPTION OF THE DRAWINGS

Like reference numerals refer to corresponding parts throughout the several views of the drawings.

DETAILED DESCRIPTION

Figure 1:
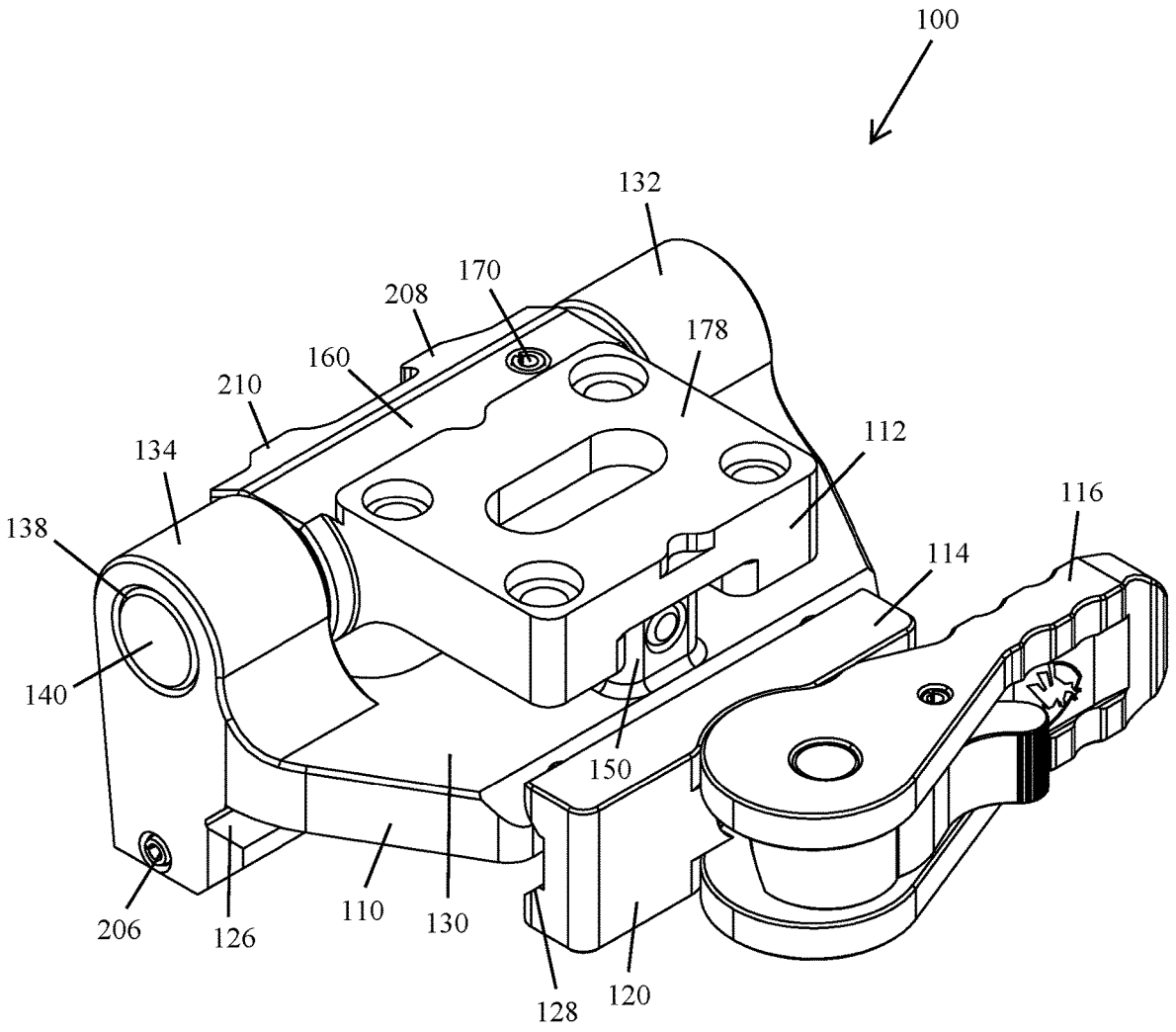
FIG. 1 is an isometric view of an example pivot mount for an optical aiming device. The optic adapter member is shown in the use position.
Figure 2:
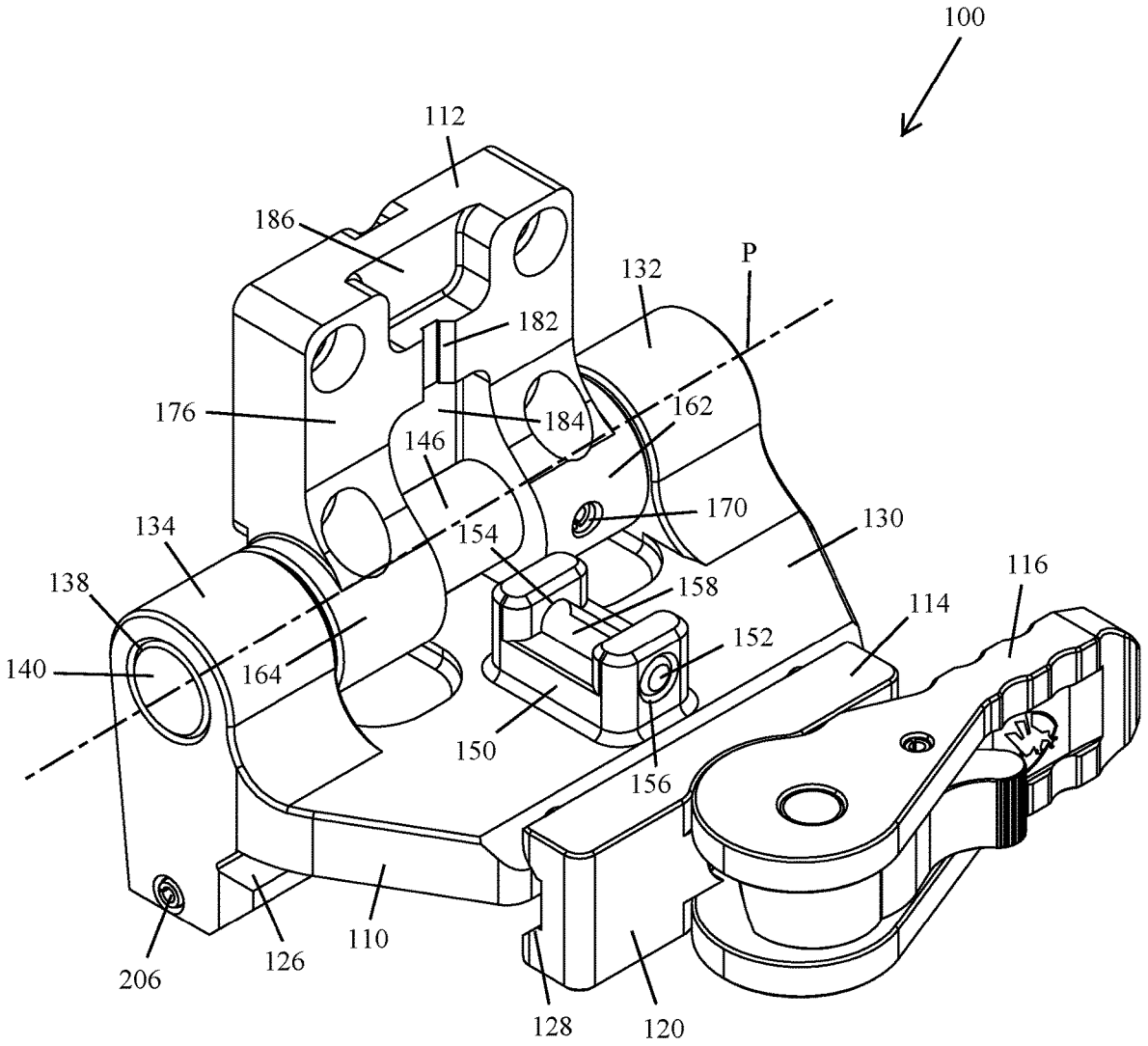
FIG. 2 is another isometric view of the example pivot mount shown in FIG. 1. The optic adapter member is shown in the storage position.

FIGS. 1 and 2 illustrate an example pivot mount 100 according to the principles of the present disclosure. The pivot mount 100 is configured to support an optical aiming device 102 and can be attached to an accessory rail 104, such as a MIL-STD-1913 rail, extending along the top of a receiver or handguard of an AR-15 type firearm. The pivot mount 100 allows an attached optical aiming device to be pivoted between a use position and a storage position. For example, an optical aiming device, such as a thermal optic, may be pivoted between a use position in which the thermal optic is positioned in a user's line of sight and a storage position in which the thermal optic is out of the user's line of sight. The pivot mount 100 is configured to ensure that the optical aiming device returns to zero, within a ¼ milliradian in some implementations, after being pivoted between the use position and the storage position.

As shown in FIGS. 1 and 2, the pivot mount 100 comprises a base 110 configured to be mounted on an accessory rail and an optic adapter member 112 that is pivotally interconnected with the base 110. An optical aiming device, such as a Trijicon SkeetIR thermal optic, can be attached to the optic adapter member 112 of the pivot mount 100.

As shown in FIGS. 1-4, the base 110 of the pivot mount 100 includes a quick release clamping mechanism 114, described in detail in U.S. Pat. No. 8,578,647, comprising a lever 116, a bolt 118, a clamp 120, and an adjustment nut 122. The pivot mount 100 is mounted to an accessory rail by the quick release clamping mechanism 114, which is fastened to the base 110 of the pivot mount 100 by the bolt 118. The base 110 has a bottom portion 124 adapted to receive MIL-STD-1913 rail. The clamp 120 of the quick release clamping mechanism 114 and the base 110 of the pivot mount 100 have opposed faces (126, 128), also referred to as mating engagement interfaces, which abut against the inclined faces of MIL-STD-1913 rail, thereby maintaining substantially precision alignment between the base 110 of the pivot mount 100 and the accessory rail.

The clamping mechanism used to secure the base 110 of the pivot mount 100 to an accessory rail is not critical to the design of the present invention. Therefore, the base 110 of the pivot mount 100 could be configured to include another clamping mechanism that is capable of releasably securing the pivot mount 100 to an accessory rail.

Figure 3:
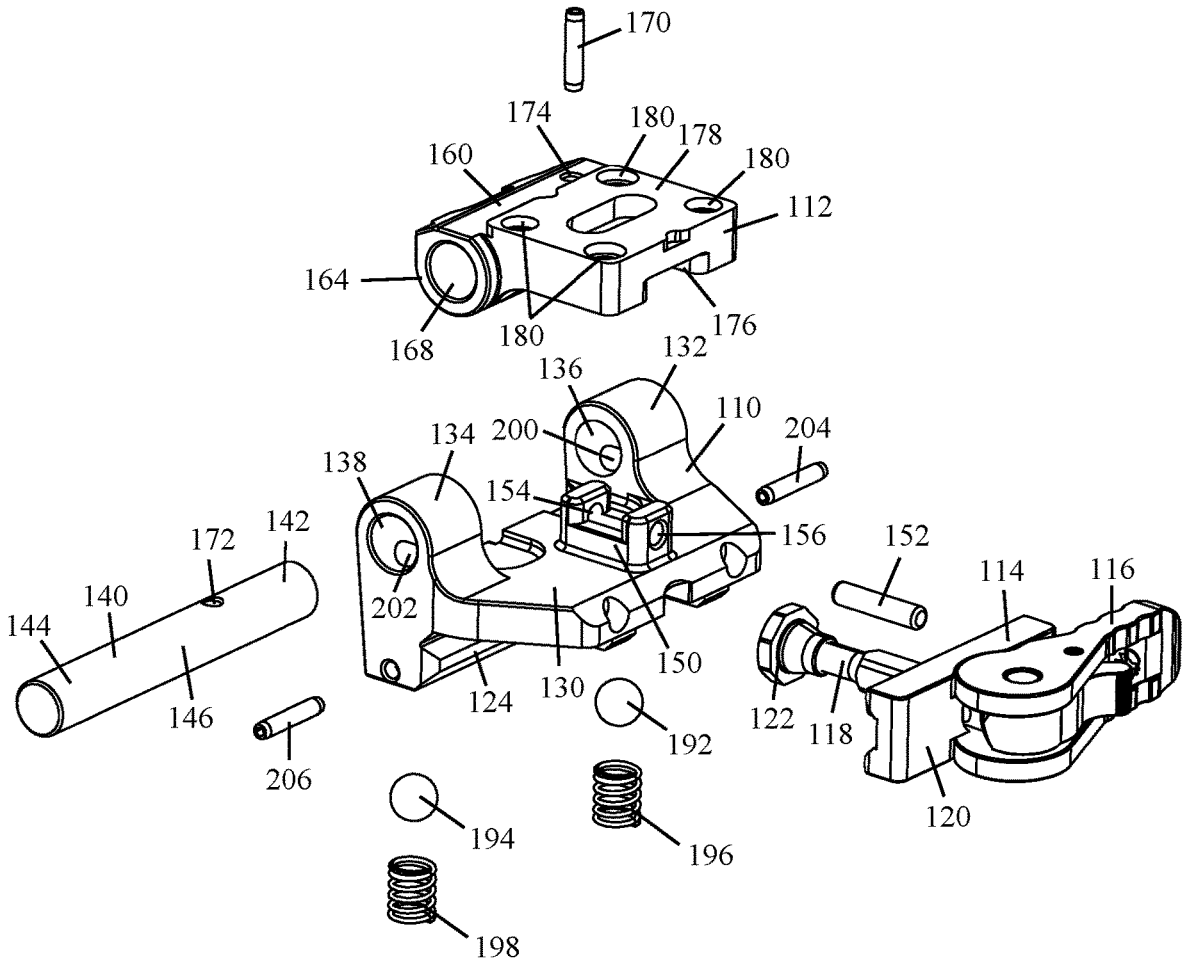
FIGS. 3 and 4 are exploded isometric views of the pivot mount shown in FIG. 1.

As shown in FIGS. 2 and 3, the base 110 of the pivot mount 100 has an upper surface 130 opposite the bottom portion 124. A pair of supports 132, 134 extend from the upper surface 130. The fore support 132 and the aft support 134 each have an aperture 136, 138, respectively, defined therethrough. These apertures 136, 138 are aligned along a fore-aft pivot axis P.

Figure 6:
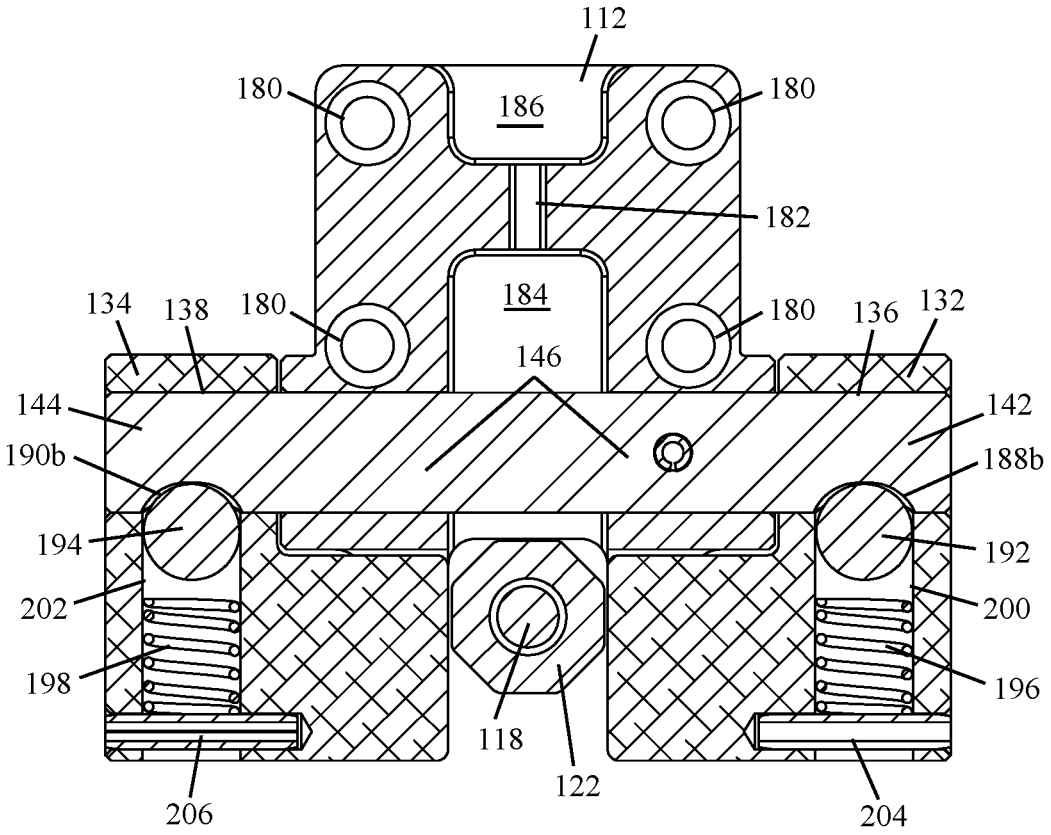
FIG. 6 is a cutaway view of the pivot mount shown in FIG. 2.
Figure 7:
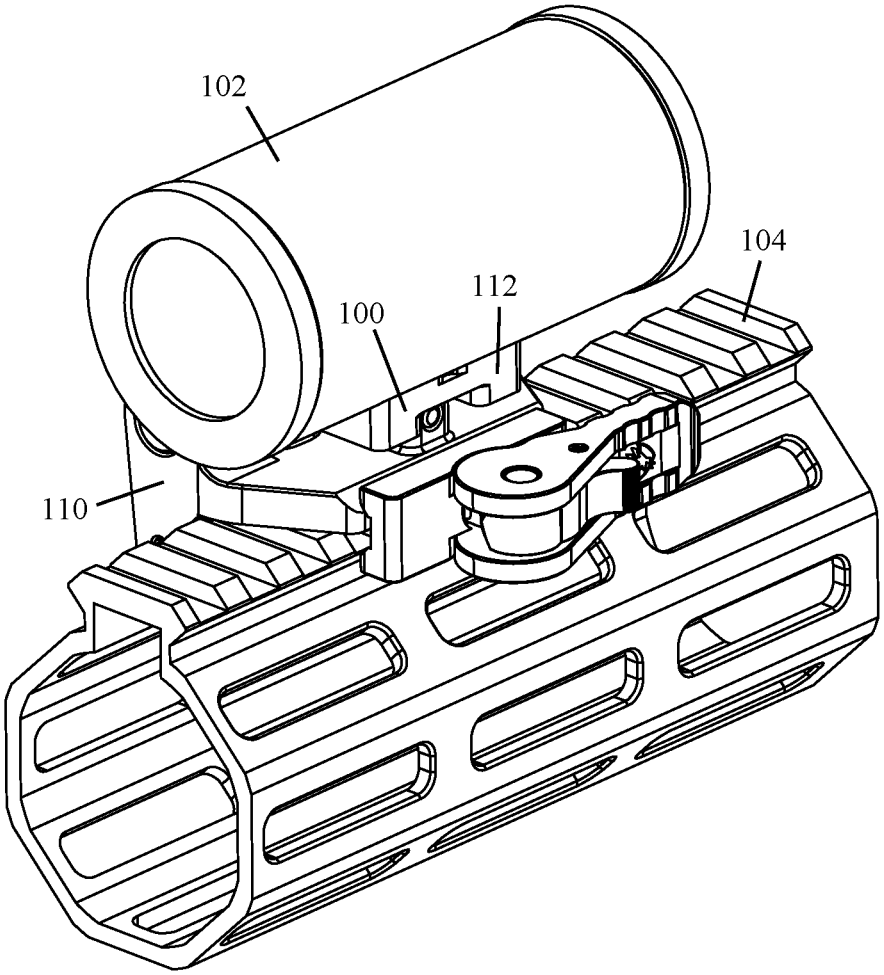
FIG. 7 is an isometric view of the pivot mount shown in FIG. 1 positioned on an accessory rail and having an optical aiming device attached to the optic adapter member.

As shown best in FIGS. 1, 2, and 6, a pivot shaft 140 engages the apertures 136, 138 in the supports 132, 134 on the base 110 such that the pivot shaft 140 extends along the fore-aft pivot axis P. Specifically, a fore section 142 of the pivot shaft 140 extends through the aperture 136 in the fore support 132 and an aft section 144 of the pivot shaft 140 extends through the aperture 138 in the aft support 134 when the pivot mount 100 is assembled. The pivot shaft 140 also has a mid-section 146 disposed between the fore section 142 and aft section 144.

As shown in FIGS. 2 and 3, the upper surface 130 of the base 110 also includes a support structure 150 for a locating pin 152. The locating pin 152, a preferred implementation of which is a dowel pin, is positioned to be orthogonal relative to the fore-aft pivot axis P defined by the base 110. The support structure 150 defines a pair of spaced transverse bores 154, 156 through which extend end portions of the locating pin 152. The locating pin 152 also has a mid-section 158 disposed between the transverse bores 154, 156 of the support structure 150.

As shown in FIGS. 1-4, the optic adapter member 112 has a laterally offset pivot portion 160 comprising a pair of spaced pivot bosses 162, 164. The pair of pivot bosses 162, 164 are configured to fit between the pair of supports 132, 134 on the base 110. The fore pivot boss 162 and the aft pivot boss 164 each have an aperture 166, 168, respectively, defined therethrough. The apertures 166, 168 receive the mid-section 146 of the pivot shaft 140. In some implementations, a roll pin 170 extends through an alignment of openings 172, 174 in the pivot shaft 140 and the fore pivot boss 162, respectively, when the pivot mount 100 is assembled. This causes the optic adapter member 112 and the pivot shaft 140 to rotate as a unit.

Figure 4:
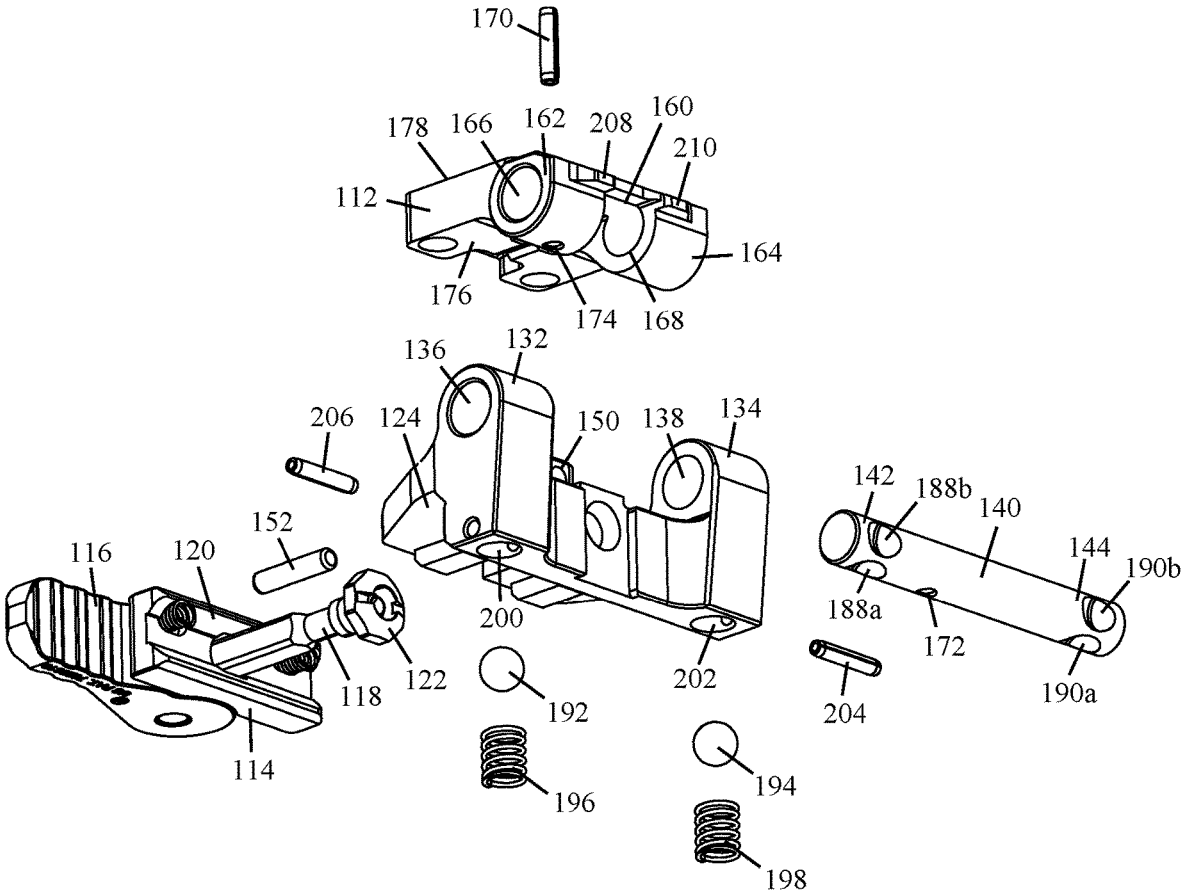

As shown in FIGS. 1 and 4, the pivot portion 160 of the optic adapter member 112 has a wing 208, 210 extending from each pivot boss 162, 164 that is configured to act as a travel stop for the optic adapter member 112 when the optic adapter member 112 is being rotated to the storage position.

As shown in FIGS. 1-4, the optic adapter member 112 also has a bottom portion 176 and an opposed upper surface 178. An optical aiming device can be mounted on the upper surface 178 of the optic adapter member 112. The upper surface 178 is configured to interface with a base of an optical aiming device. The optic adapter member 112 includes openings 180 therein that align with threaded openings in the base of an optical aiming device. In this way, threaded fasteners can be used to secure the optical aiming device to the upper surface 178 of the optic adapter member 112.

While the example pivot mount 100 shown in the illustrations is configured for use with a Trijicon SkeetIR thermal optic, the optic adapter member 112 of the pivot mount 100 could be adapted for use with another optical aiming device.

Figure 5:
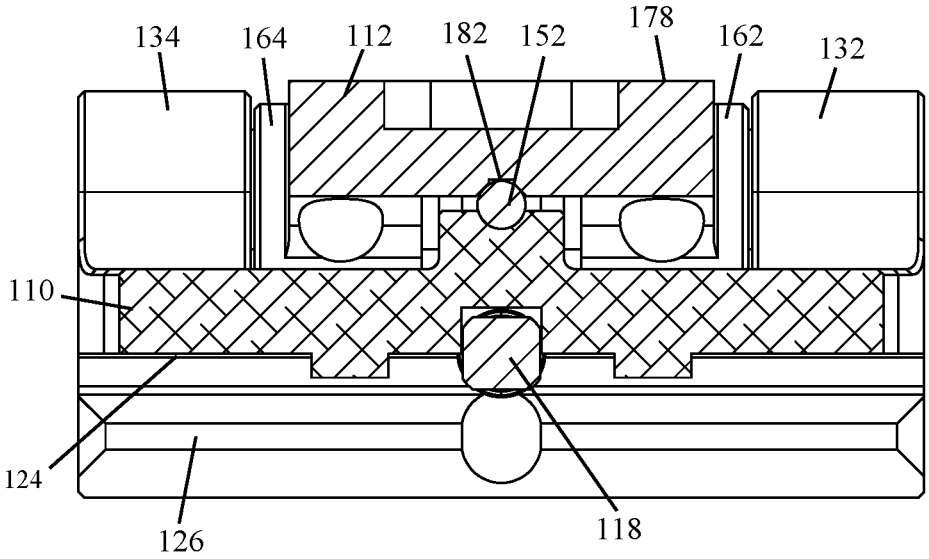
FIG. 5 is a cutaway view of the pivot mount shown in FIG. 1.

As shown in FIGS. 2 and 5, the bottom portion 176 of the optic adapter member 112 includes a chamfered groove 182 configured to receive the locating pin 152 on the upper surface 130 of the base 110. Specifically, when the optic adapter member 112 is in the use position, the mid-section 158 of the locating pin 152 is positioned within the chamfered channel 182 on the bottom portion 176 of the optic adapter member 112. Together, the chambered channel 182 and the locating pin 152 are configured to consistently position the optic adapter member 112 relative to the base 110 of the pivot mount 100. In this way, the pivot mount 100 is configured to ensure a return to zero for an optical aiming device attached to the optic adapter member 112.

As shown in FIG. 2, the bottom portion 176 of the optic adapter member 112 also includes a clearance slot 184, 186 positioned adjacent each end of the chamfered channel 182. Each clearance slot 184, 186 is configured to receive, but not make contact with, an end of the support structure 150 holding the locating pin 152.

The pivot mount 100 also includes a force-to-overcome mechanism configured to provide stabilized, consistent location of the optic adapter member 112 in each of the two positions and resistance to movement from each position. The force-to-overcome mechanism is also configured such that manual movement of the optic adapter member 112 by a user overcomes the resistance provided thereby and allows the optic adapter member 112 to be pivoted between the use position (see, e.g., FIG. 1) and the storage position (see, e.g., FIG. 2). A preferred implementation of the fore-to-overcome mechanism comprises detent recesses in the pivot shaft 140 and a pair of spring-biased ball detents captured within the base 110 of the pivot mount 100.

As shown in FIG. 4, the fore section 142 and the aft section 144 of the pivot shaft 140 each have two detent recesses (188*a*, 188*b* and 190*a*, 190*b*), respectively, defined therein. The two detent recesses (188*a*, 188*b* and 190*a*, 190*b*) in each section 142, 144 of the pivot shaft 140 are substantially 90 degrees offset from each other. However, in some implementations, the detent recesses in each section 142, 144 of the pivot shaft 140 may be more than 90 degrees offset from each other. A ball detent 192, 194 engages in one detent recess 188*a*, 190*a* in each section 142, 144, respectively, of the pivot shaft 140 when the optic adapter member 112 is in the use position; the ball detent 192, 194 engages in another detent recess 188*b*, 190*b* in each section 142, 144, respectively, of the pivot shaft 140 when the optic adapter member 112 is in the storage position (see, e.g., FIG. 6). Each ball detent 192, 194 is biased into a detent recess by a spring 196, 198. Each ball detent 192, 194 and spring 196, 198 combination is positioned within bore 200 or 202 in the base 110 that extends from the aperture 136, 138 in the fore support 132 or the aft support 134, respectively. In some implementations, a roll pin 204, 206 is used to capture the ball detent 192, 194 and spring 196, 198 within the bore 200, 202 (see, e.g., FIG. 6).

Although the preferred implementation of the force-to overcome mechanism comprises two spring-biased ball detents, the pivot mount 100 could be configured to include only one spring-biased ball detent.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown, or in sequential order, or that all illustrated operations be performed, to achieve desirable results.

The invention claimed is:

1. A pivot mount for an optical aiming device, the pivot mount comprising:

a base configured for attachment to an accessory rail;

a pivot shaft; and an optic adapter member pivotally secured to the base by the pivot shaft;

wherein:

the base includes a bottom portion and an upper surface, the bottom portion is configured to engage the accessory rail, the upper surface includes a locating pin;

the optic adapter member includes an upper surface and a bottom portion, the upper surface is configured for attachment of the optical aiming device, the bottom portion includes a chamfered groove configured to receive the locating pin on the upper surface of the base, the optic adapter member pivoting around the pivot shaft between a use position in which the bottom portion of the optic adapter member is adjacent the upper surface of the base and a storage position in which the bottom portion of the optic adapter member is pivoted away from the upper surface of the base;

the locating pin on the upper surface of the base is received within the chamfered groove on the bottom portion of the optic adapter member when the optic adapter member is in the use position; the upper surface of the base includes a support structure for the locating pin, the support structure defines a pair of spaced transverse bores through which extend end portions of the locating pin, a mid-section of the locating pin is disposed between the transverse bores; the chamfered groove of the optic adapter member is configured to receive the mid-section of the locating pin.

2. The pivot mount of claim 1, wherein the locating pin is positioned to be orthogonal relative to the pivot shaft.

3. The pivot mount of claim 2, wherein the locating pin is a dowel pin.

4. A pivot mount for an optical aiming device, the pivot mount comprising:

a base configured for attachment to an accessory rail;

a pivot shaft; and an optic adapter member pivotally secured to the base by the pivot shaft;

wherein:

the base includes a bottom portion and an upper surface, the bottom portion is configured to engage the accessory rail, the upper surface includes a fore support and an aft support, the supports each having an aperture defined therethrough, the apertures are aligned along a fore-aft pivot axis, the upper portion also includes a locating pin;

the pivot shaft engages the apertures in the supports of the base such that the pivot shaft extends along the fore-aft pivot axis;

the optic adapter member includes an upper surface and a bottom portion, the upper surface is configured for attachment of the optical aiming device, the bottom portion includes a chamfered groove configured to receive the locating pin of the base, the optic adapter member pivoting around the fore-aft pivot axis between a use position in which the bottom portion of the optic adapter member is adjacent the upper surface of the base and a storage position in which the bottom portion of the optic adapter member is pivoted away from the upper surface of the base;

the locating pin on the upper surface of the base is received within the chamfered groove on the bottom portion of the optic adapter member when the optic adapter member is in the use position; the locating pin is held by a support structure on the upper surface of the base, the support structure defines a pair of spaced transverse bores through which extend end portions of the locating pin, a mid-section of the locating pin is disposed between the transverse bores; the chamfered groove of the optic adapter member is configured to receive the mid-section of the locating pin.

5. The pivot mount of claim 4, wherein the locating pin is positioned to be orthogonal relative to the fore-aft pivot axis of the base.

6. The pivot mount of claim 5, wherein the locating pin is a dowel pin.

* * * * *